US007514615B2

(12) United States Patent
Ribbecke

(10) Patent No.: US 7,514,615 B2
(45) Date of Patent: Apr. 7, 2009

(54) STRINGED MUSICAL INSTRUMENT HAVING A HYBRID ARCH-TOP AND FLAT-TOP SOUNDBOARD

(75) Inventor: Thomas Lawrence Ribbecke, Healdsburg, CA (US)

(73) Assignee: Ribbecke Guitar Corp., Healdsburg, CA (US)

( * ) Notice: Subject to any disclaimer, the term of this patent is extended or adjusted under 35 U.S.C. 154(b) by 0 days.

(21) Appl. No.: 11/284,461

(22) Filed: Nov. 21, 2005

(65) Prior Publication Data

US 2006/0230904 A1 Oct. 19, 2006

Related U.S. Application Data

(60) Provisional application No. 60/673,236, filed on Apr. 19, 2005.

(51) Int. Cl.
*G10D 3/02* (2006.01)

(52) U.S. Cl. ..... 84/294; 84/291

(58) Field of Classification Search ..... 84/291, 84/292, 267, 268, 275, 307, 294
See application file for complete search history.

(56) References Cited

U.S. PATENT DOCUMENTS

| | | | | | |
|---|---|---|---|---|---|
| 567,028 | A | | 9/1896 | Hall | |
| D27,560 | S | | 8/1897 | Howe | |
| 863,246 | A | * | 8/1907 | Wood | 84/274 |
| 1,361,182 | A | * | 12/1920 | Reams, Jr. et al. | 84/291 |
| 2,414,238 | A | | 1/1947 | Osburn | 84/263 |
| 2,837,953 | A | | 6/1958 | Baschet | 84/275 |
| 4,016,793 | A | * | 4/1977 | Kasha | 84/307 |
| 4,320,684 | A | | 3/1982 | Podunavac | 84/291 |
| 4,362,079 | A | * | 12/1982 | Kelly | 84/291 |
| 4,467,692 | A | * | 8/1984 | Egan | 84/291 |
| 4,539,887 | A | * | 9/1985 | Bjerkas | 84/314 R |
| 6,459,024 | B1 | | 10/2002 | Baker | 84/291 |
| 6,696,627 | B2 | | 2/2004 | Florath et al. | 84/290 |

(Continued)

OTHER PUBLICATIONS

"2004 GAL Convention Coverage," American Lutherie No. 79, Fall 2004, p. 1, 24-26, regarding lecture to Guild of American Luthiers at GAL Convention in Tacoma, WA, Jul. 2004.

(Continued)

*Primary Examiner*—Ross N Gushi
(74) *Attorney, Agent, or Firm*—Weaver Austin Villeneuve & Sampson LLP

(57) ABSTRACT

Disclosed are a stringed musical instrument and related methods and apparatus. A longitudinal axis is situated along a length of the body of the stringed musical instrument. The body includes a soundboard having a lower region on a bass side with respect to the longitudinal axis and a higher region on a treble side with respect to the longitudinal axis opposite the bass side. The lower region of the soundboard is shaped to have a flat contour, while the higher region is shaped to have an arched contour. A neck is attached to the body. The neck has a hub adapted to couple one or more strings at a first end. A bridge is fitted to the soundboard. The bridge is adapted to seat the one or more strings when extended over at least a portion of the neck and body and coupled to the body at a second end opposite the first end.

37 Claims, 12 Drawing Sheets

U.S. PATENT DOCUMENTS

| | | | | |
|---|---|---|---|---|
| 7,015,390 | B1 * | 3/2006 | Rogers | 84/723 |
| 7,230,174 | B1 * | 6/2007 | Wilson | 84/267 |
| 2002/0043146 | A1 | 4/2002 | McPherson | 84/291 |
| 2003/0154843 | A1 * | 8/2003 | McPherson | 84/291 |
| 2004/0182221 | A1 * | 9/2004 | Burrell | 84/291 |
| 2005/0022650 | A1 | 2/2005 | Untermyer et al. | 84/291 |

OTHER PUBLICATIONS

Marshall Brain, "How Acoustic Guitars Work" http://entertainment.howstuffworks.com/guitar.htm/printable, pp. 1-11.

* cited by examiner

STRINGED MUSICAL INSTRUMENT HAVING A HYBRID ARCH-TOP AND FLAT-TOP SOUNDBOARD

REFERENCE TO EARLIER-FILED APPLICATION

This application claims priority from co-pending and commonly assigned U.S. Provisional Patent Application No. 60/673,236, Ribbecke, for HYBRID ARCH-TOP AND FLAT-TOP SOUNDBOARD FOR MUSICAL INSTRUMENT, filed on Apr. 19, 2005, which is hereby incorporated by reference.

BACKGROUND

The present invention relates to musical instruments and, more particularly, to stringed musical instruments having soundboards, such as guitars.

Stringed musical instruments have been played and enjoyed, both by players and listeners, for many years. These instruments are often characterized by a body, a neck attached to the body, and one or more strings suspended under controllable tension from a bridge mechanically coupled to a soundboard of the body to a hub located at one end of the neck. As the string is vibrated by suitable means such as picking, plucking, strumming, bowing, hammering, tapping, or scratching, the vibrations induced in the string are transmitted by the bridge to the soundboard. The body collects and directs the sounds by exciting air proximate the soundboard.

While stringed musical instruments have been refined and improved over the years, they have been characterized by some drawbacks, such as non-linear frequency response. In particular, unacceptably low output amplitudes for the lower notes of the instrument's voice and lack of clarity between courses, that is, frequencies generating by sounding one or more strings, are drawbacks of conventional stringed musical instruments.

The "Sound Bubble" series of instruments addressed some of the drawbacks of conventional stringed musical instruments. The Sound Bubble is described in U.S. Pat. No. 4,362,079, Ribbecke, issued Dec. 7, 1982, which is hereby incorporated by reference. The Sound Bubble instrument includes a thin, dome-shaped accentuator plate located on the bass side of the soundboard. The Sound Bubble instrument achieved an articulate clean bass and separation between courses often associated with an arch-top. However, more bass output, i.e., higher amplitude of the lower frequencies, was desired.

Therefore, a need still exists for an improvement in stringed musical instruments that both enhances the bass response, that is, increases the volume of the low notes or bass frequencies, and provides the desired articulation and separation between courses.

SUMMARY OF THE INVENTION

Aspects of the present invention provide a stringed musical instrument and related methods and apparatus. A longitudinal axis is situated along a length of the body of the stringed musical instrument. The body includes a soundboard having a lower region on a bass side with respect to the longitudinal axis and a higher region on a treble side with respect to the longitudinal axis opposite the bass side. The lower region of the soundboard is shaped to have a substantially flat contour, while the higher region is shaped to have a substantially arched contour. A neck is attached to the body. The neck has a hub adapted to couple one or more strings at a first end. A bridge is fitted to the soundboard. The bridge is adapted to seat the one or more strings when extended over at least a portion of the neck and body and coupled to the body at a second end opposite the first end.

These and other features and benefits of aspects of the invention will be described in more detail below with reference to the associated drawings.

DETAILED DESCRIPTION

Reference will now be made in detail to some specific embodiments of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. Moreover, numerous specific details are set forth below in order to provide a thorough understanding of the present invention. The present invention may be practiced without some or all of these specific details. In other instances, well known operations and components have not been described in detail in order not to obscure the present invention.

Stringed musical instruments constructed in accordance with embodiments of the present invention blend the bass response of a flat-top and the articulation of the arch-top into one instrument. In various embodiments, the bass side of the soundboard is generally flat or compliant to provide improved bass response, and the treble side of the soundboard is generally carved to help provide a clearer separation and a clarity when notes are played individually or in combination. Additional features contributing to the improved bass response and articulation are described below.

In general, embodiments of the present invention stem from the concept of the stringed musical instrument as an energy management system, where a finite amount of energy is converted from the first oscillator, the strings, to the second, the bridge, to the ultimate oscillator, the top, and finally to excite the air. Embodiments of the present invention attempt to maximize the stiffness-to-weight ratio, through the use of modern materials like carbon fiber. Impedance-to-energy transfer at the interfaces of the various oscillators is also taken into account. For this reason, harder materials (e.g., mahogany end blocks and tail blocks) and finger joints in tailpiece design are desirably used to maximize surface area. Embodiments of the present invention having X-braces are desirably built using tight and stiff X-brace material. Stringed musical instruments constructed in accordance with embodiments of the present invention are often made from wood, although other suitable materials can be used. The selection of wood desirably takes into consideration the speed of sound in wood as evidenced by the G. Lucchi meter which measures sound transmission and elasticity.

Figure 1:
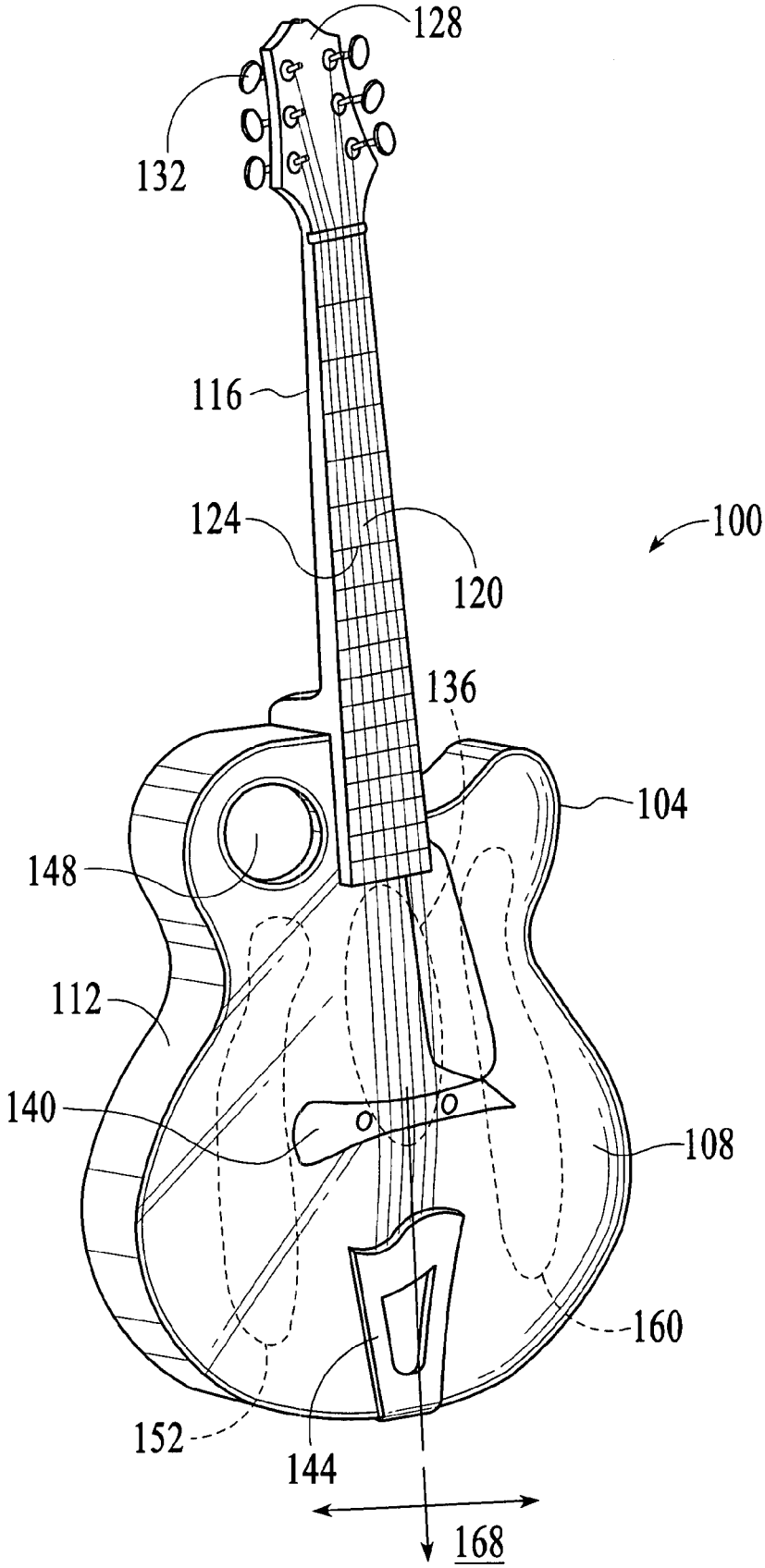
FIG. 1 shows a front view of a hollow body guitar 100 having a hybrid arch-top and flat-top soundboard, constructed according to one embodiment of the present invention.

FIG. 1 shows a front view of a hollow body guitar 100 having a hybrid arch-top and flat-top soundboard, constructed according to one embodiment of the present invention. The guitar 100 has a body 104 including a top or soundboard 108, a side or sides 112 and a back. In one embodiment, the soundboard is formed of a single piece of material, such as wood. In another embodiment, the soundboard is formed of two or more pieces of material glued or otherwise fitted together and shaped to define the soundboard 108 as shown in FIG. 1. A neck 116 has a first end attached to the body 104 and extends from the body 104 in one direction to a second end opposite the first end. The neck 116 includes a fretboard 120 having frets 124. Those skilled in the art will appreciate that the guitar 100 could be constructed without frets 124 for players desiring a fretless stringed instrument. A headstock 128 is located at the end of the neck 116 opposite the body 104. The headstock includes tuning keys or pegs 132 to which strings are attached and extended over fretboard 120 along the neck 116 and over soundboard 108. The strings pass over a bridge 140 and are attached to a tailpiece 144 fitted to a lower portion of body 104.

Those skilled in the art will appreciate that headstock 128 represents one form of hub, i.e. string coupling mechanism for attaching strings. Other suitable string coupling mechanisms are contemplated within the spirit and scope of embodiments of the present invention. For example, in an alternative guitar embodiment, headstock 128 is replaced with Steinberger's Combo™ Headpiece found, for instance, in Steinberger Synapse SS-2FA custom model guitars. As used herein, the term "neck" often refers inclusively to the neck and a suitable hub such as a headstock or headpiece.

In FIG. 1, in guitar 100, a hole 148 is formed in soundboard 108. Openings formed in the soundboard, such as hole 148, enable air interchange between the interior and exterior of the guitar, affecting the bass resonance of the guitar when the strings vibrate. An adjustable port device can be fitted in the hole to vary the Helmholtz frequency, the lowest fundamental frequency, as the port is opened and closed. In guitar 100, while no hole is formed in the center of soundboard 108, those skilled in the art will appreciate that other alternative embodiments of guitar 100 can have a sound hole formed in the center of soundboard 108 under the strings or any other suitable position on the soundboard 108, as is desired with many acoustic guitars. Additionally, the port device is optional.

In FIG. 1, the soundboard 108 of novel guitar 100 includes a lower or bass region 152 adjacent to a transition region 136. The lower region 152 is often proximate to the bass or heavier strings of the guitar. For example, in a six-string guitar having a standard tuning, lower region 152 is closest to the low E string. A higher or treble region 160 of soundboard 108 is located adjacent to transition region 136 but opposite bass region 152. In the six-string guitar with standard tuning example, the higher region 160 is proximate the high E string. Those skilled in the art will appreciate that this reference to strings is intended for illustrative purposes only, and is not meant to be at all limiting to the scope of the present invention. Strings can be strung and tuned in any manner desired by the player. For example, the strings could be reversed in order, or guitar 100 could be strung and tuned with a Nashville tuning. Any and all such variations are contemplated within the scope of the present invention.

The soundboard 108 is constructed so that bass region 152 has a flat contour. The treble region 160, on the other hand, is formed to have an arched contour. Thus, the single soundboard 108 of guitar 100 includes both a lower flat-top region 152, and a higher arched-top region 160. The lower flat-top region is substantially flat and has minimal curvature. In one embodiment, the arched treble region has a curvature that has a height above a plane defined along the flat-top region. In one example, this height is about ⅜ inches. A skilled luthier can perform the desired shaping of the soundboard.

In FIG. 1, a longitudinal axis 168 runs a length of the guitar, often parallel to neck 116. The longitudinal axis 168 represents a conceptual division between the lower flat-top region 152 and higher arch-top region 160 of guitar 100. That is, lower region 152 is on a first, i.e. bass side of the longitudinal axis 168, while higher region 160 is on a second, i.e. treble side of the longitudinal axis 168 opposite the bass side. In one embodiment, as illustrated, the longitudinal axis 168 is in line with and centered with the neck 116, essentially bisecting the guitar 100 into halves. For example, on a six-string guitar as shown in FIG. 1, a centrally located axis 168 would often be situated between the third and fourth strings of the guitar.

In an alternative embodiment, the longitudinal axis 168 is offset with respect to the center of the neck 116, that is, located along a different length of the body 104, depending on the desired construction. The decision for locating longitudinal axis 168 can take into account luthier intuition as well as player preference. The longitudinal axis 168 can be shifted to the left or right, as shown in FIG. 1. For example, longitudinal axis 168 could be shifted towards higher region 160 so that only 25% of soundboard 108 is arched, while 75% of soundboard 108 is flat. Alternatively, longitudinal axis 168 can be shifted towards the lower flat-top region 152, so that the higher arch-top region 160 forms a larger percentage of the surface area of the soundboard 108. Bracing and brace placement, top curvature and thickness provide additional tools to create the desired result.

In FIG. 1, middle or transition region 136 of soundboard 108 is generally formed between the lower region 152 and higher region 160. In one embodiment, transition region 136 is shaped to have a gradual transition from the flat contour of lower region 152 to the arched contour of higher region 160. The real estate of soundboard 108 occupied by transition region 136 varies, as does the rate of transition between the flat and arched contours, depending on the desired construction. For instance, in the above example of the 25% archtop, a flatter bass region 152 of the soundboard and a more gradual transition in region 136 to the treble region 160 could be provided. If the opposite result was desired, these proportions could be reversed.

Figure 2:
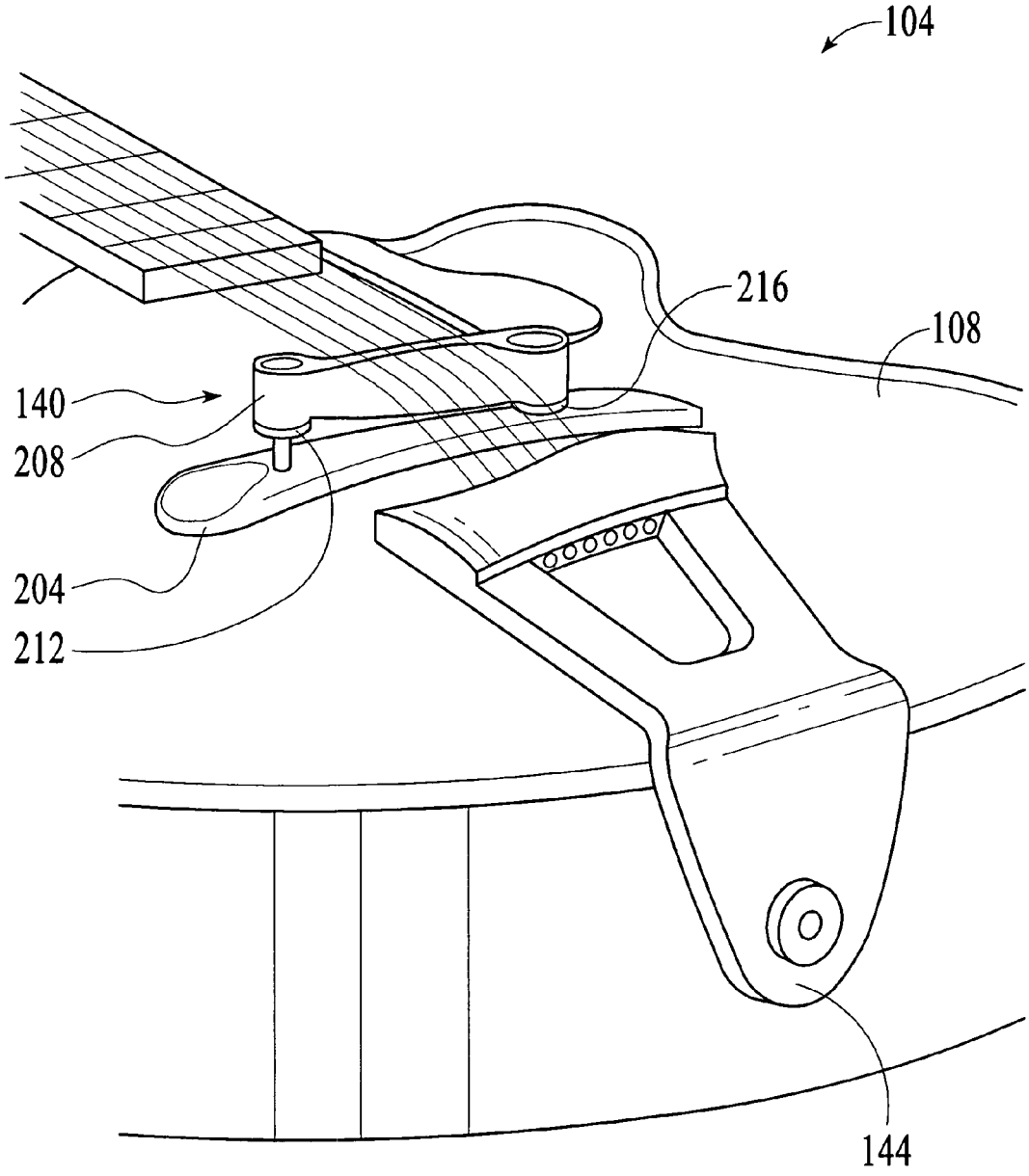
FIG. 2 shows a perspective view of the body of guitar 100, including hybrid arch-top and flat-top soundboard 108, constructed according to one embodiment of the present invention.

FIG. 2 shows a perspective view of the body of guitar 100, including hybrid arch-top and flat-top soundboard 108, constructed according to one embodiment of the present invention. A bridge assembly 140 includes a sustain plate 204 mounted to the surface of soundboard 108. Extending up and away from sustain plate 204 and soundboard 108 are two screws 212 and 216 to which the bridge 208 is attached. As shown, a greater distance appears between bridge 208 and sustain plate 204 along the length of lower screw 212, in contrast with essentially no space between bridge 208 and sustain plate 204 on the treble side of soundboard 108 along the length of screw 216. Even though the strings have a generally consistent height above the fingerboard of neck 116, the larger distance along screw 212 is due to the difference in contours between the lower region 152 and higher region 160 of soundboard 108. That is, because bridge assembly 140 including screw 212 is seated above the lower flat-top region 152, while screw 216 is situated above the higher arched region 160, the portion of bridge 208 proximate screw 212 must be raised a greater distance above sustain plate 204 and soundboard 108 to compensate for the difference in contours of the respective regions 152 and 160.

As used herein, the terms "bridge" and "bridge assembly" are often used interchangeably. For instance, guitar 100 has a bridge assembly 140 with several components including a sustain plate, bridge, screws, saddles, and related coupling devices. In an alternative embodiment, bridge assembly 140 is replaced with a more integrated bridge, similar to those appearing on a conventional acoustic flat-top guitar such as a Martin D-28 model.

Figure 3:
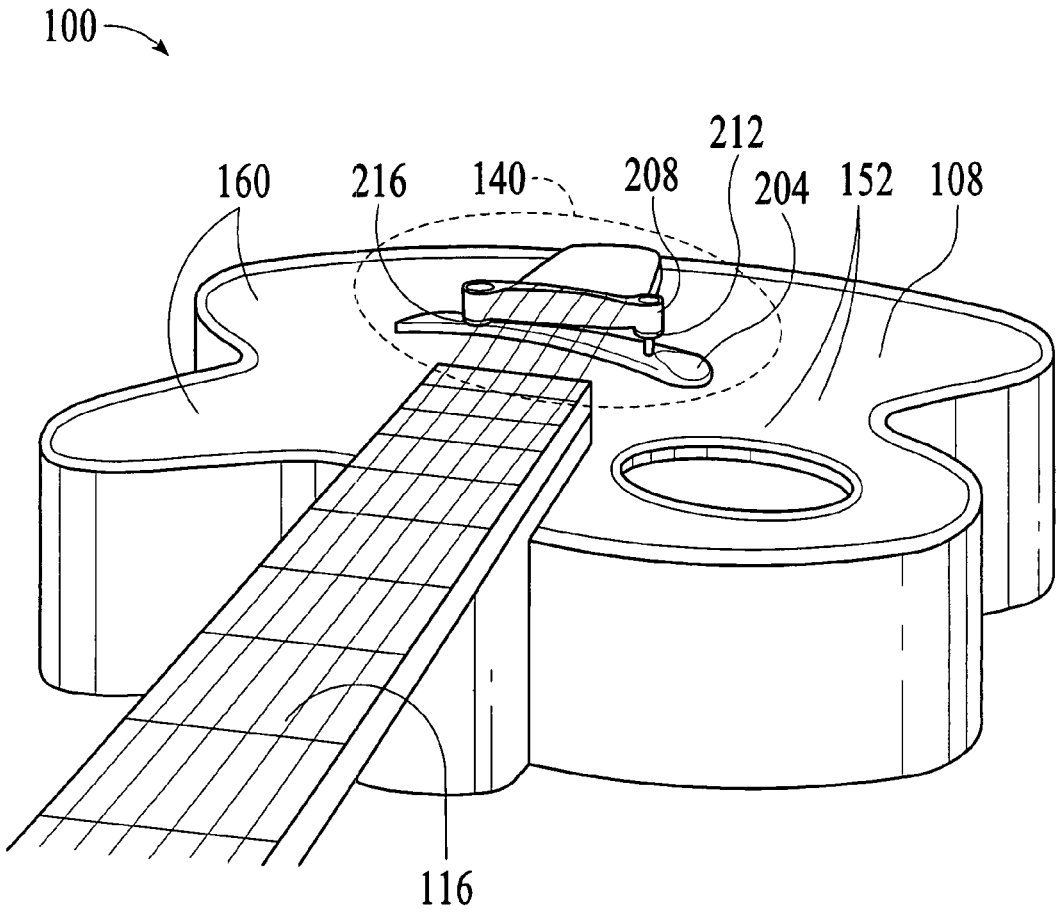
FIG. 3 shows a perspective view of the body of guitar 100, including hybrid arch-top and flat-top soundboard 108, constructed according to one embodiment of the present invention.

FIG. 3 shows a perspective view of soundboard 108 and body 104 from the neck 116 of guitar 100. As shown, the lower region 152 of soundboard 108 has a flat contour, while the higher region 160 of soundboard 108 has a generally arched contour. Again, because of the difference in contours between the lower region 152 and higher region 160, the bridge 208 of bridge assembly 140 is raised above the soundboard 108 and sustain plate 204 along screw 212 a greater distance than on the higher side along screw 216.

Figure 4:
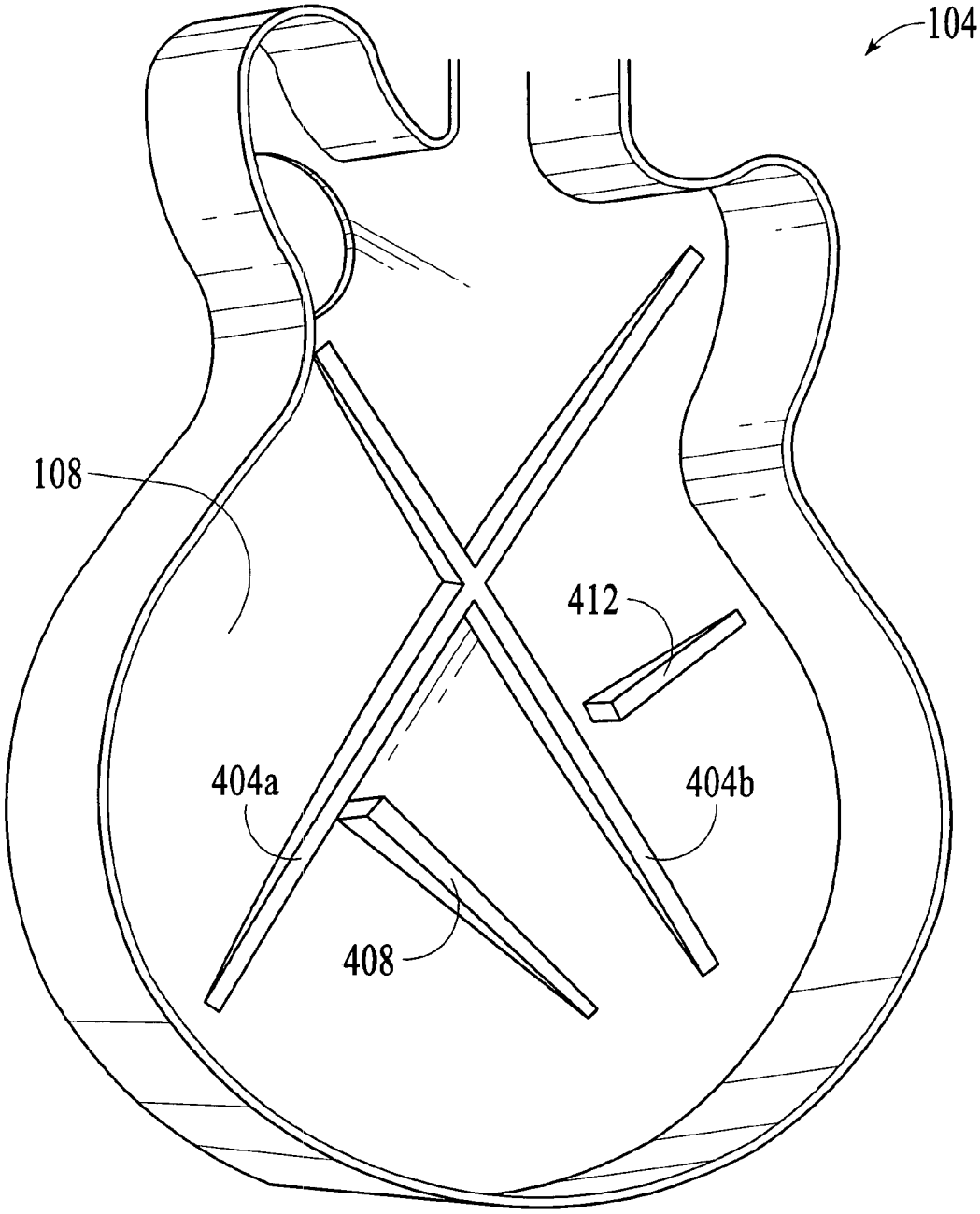
FIG. 4 shows an internal view of the body of guitar 100, including a rear view of hybrid arch-top and flat-top soundboard 108, constructed according to one embodiment of the present invention.

FIG. 4 shows an internal view of the body of guitar 100, including a rear view of hybrid arch-top and flat-top soundboard 108, constructed according to one embodiment of the present invention. In one embodiment, the interior side of soundboard 108 includes X braces 404*a* and 404*b* fitted as shown. In one embodiment, as shown, one or two extra stiffening braces 408 and 412 are added and fitted to the interior side of soundboard 108, often on the lower region 152 of soundboard 108. These X braces 404 and stiffening braces 408 and 412 can be glued or otherwise attached to the interior of soundboard 108, as will be understood by those skilled in the art.

Figure 5:
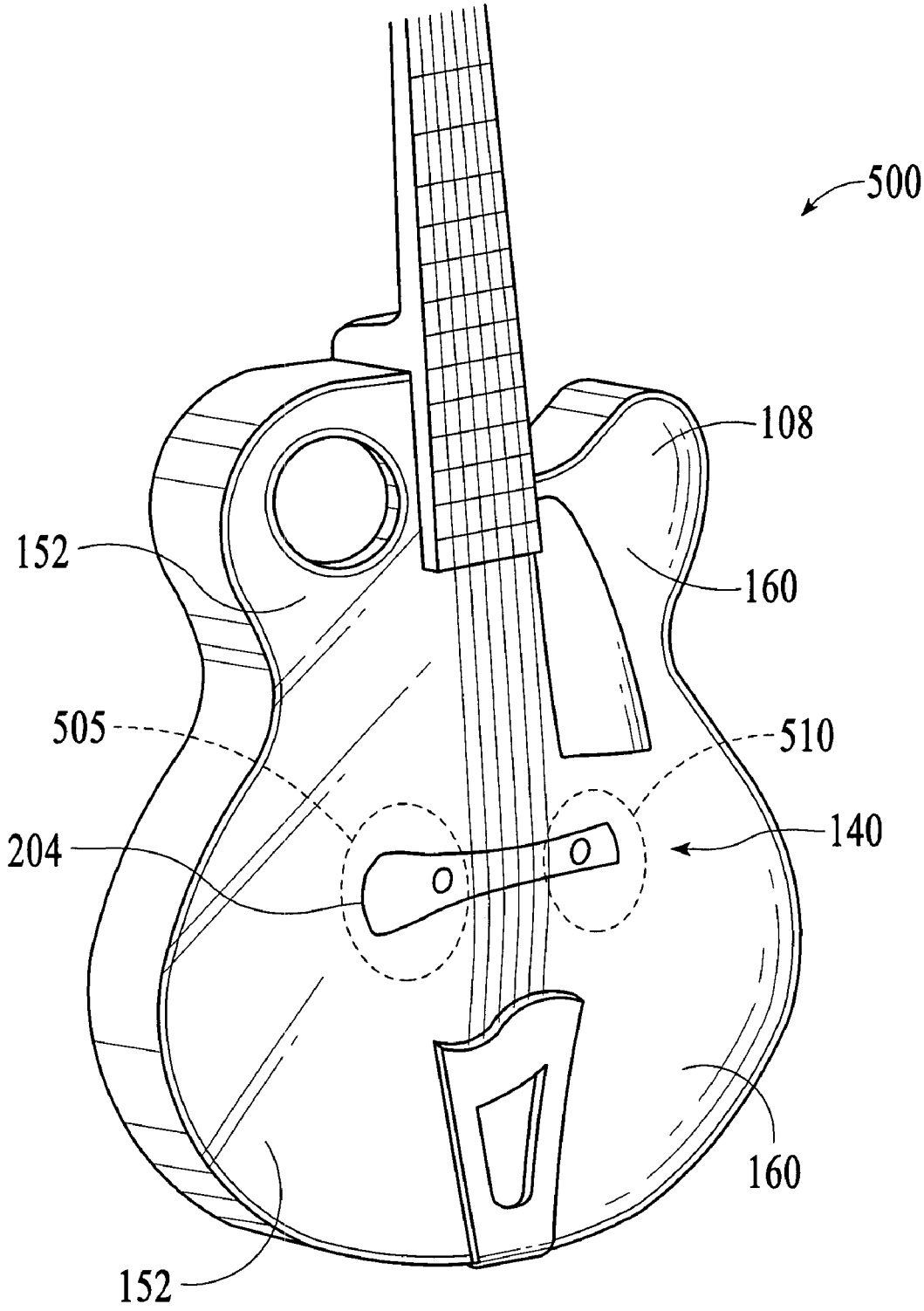
FIG. 5 shows a front view of a bass guitar 500 having a hybrid arch-top and flat-top soundboard, constructed according to one embodiment of the present invention.
Figure 6:
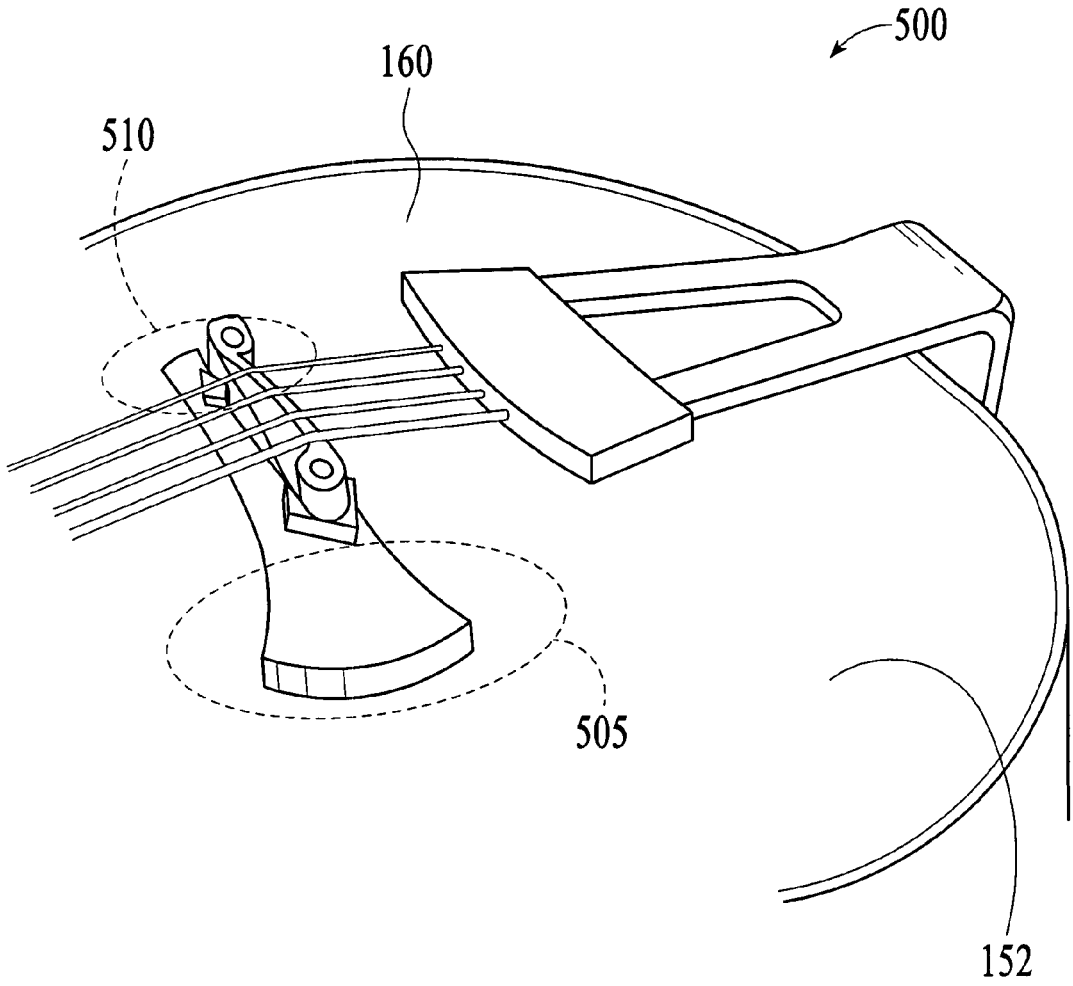
FIG. 6 shows a perspective view of the body of bass guitar 500, including hybrid arch-top and flat-top soundboard 108, constructed according to one embodiment of the present invention.

FIG. 5 shows a front view of a bass guitar 500 having a hybrid arch-top and flat-top soundboard, constructed according to one embodiment of the present invention. Bass guitar 500 includes the novel features described above with respect to guitar 100. The bridge assembly 140 attached to soundboard 108 of bass guitar 500 includes a sustain plate 204 having a larger surface area on a lower portion 505 proximate the lower region 152 than a higher portion 510 proximate higher region 160 of soundboard 108, also shown in FIG. 6. This sort of bridge assembly 140 including sustain plate 204 is purposely wider and thinner on the lower portion 505 than the higher portion 510 to better match the different impedances for each side.

The guitars 100 and 500 of FIGS. 1 and 5, formed with flat bass regions 152 of the soundboard 108, have improved bass power. The soundboard functions partially in a monopole mode and has one aspect where bass and treble are produced all over the top. Still, there are additional layers to the soundboard performance. A dominant dipole function allows for greater differentiation of bass and treble sounds, which is often quite evident to the listener. The bass guitar 500 takes advantage of the advanced response in the lower register and seems to image well, so that the listener perceives being "surrounded" by the sound.

In FIG. 1, in one specific implementation, the soundboard 108 of guitar 100 is approximately 0.140" thick and about 1" around the perimeter. The bass region 152 retains this thickness until it reaches almost 4" into a circle which can be drawn using the bridge 140 as its center point. It then gradually increases in thickness until it is approximately 0.190" under the center of bridge 140. The graduations moving toward the treble region 160 are: 0.200", 0.190", 0.180", 0.170", 0.160." Those skilled in the art will appreciate that other suitable gradations may be used within the spirit and scope of the present invention.

In this specific implementation, the back of guitar 100 is symmetrical and approximately 0.180" in the center with a slight graduation to about 0.160." The scale is 25", sides are 3" thick. The soundboard 108 is Sitka spruce on the guitar 100 and cedar for the bass 500. The back and sides of the bass 500 are Myrtle (California Bay Laurel, *Umbellularia californica*), and quilted mahogany on the guitar 100. Those skilled in the art will appreciate that other suitable materials may be substituted within the spirit and scope of the present invention.

Principles of the present invention are applicable to various stringed musical instruments, including acoustic guitars, electric guitars, acoustic and electric bass instruments, various orchestral stringed instruments such as violins, violas, cellos, and upright basses, as well as dulcimers, mandolins, resonators, and any other musical instrument having a soundboard excited by acoustic energy from a source such as a string that, in turn, excites the air around the soundboard. The various stringed musical instruments to which principles of the present invention are applicable further include left-handed instruments, right-handed instruments, 1-string instruments, 2-string instruments, 3-string instruments, 4-string instruments, 5-string instruments, 6-string instruments such as a 6-string guitar, 7-string instruments such as a 7-string guitar, and 12-string instruments such as a 12-string guitar. Such stringed musical instruments are generally sold and carried in appropriately fitting cases or gig bags.

Figure 7:
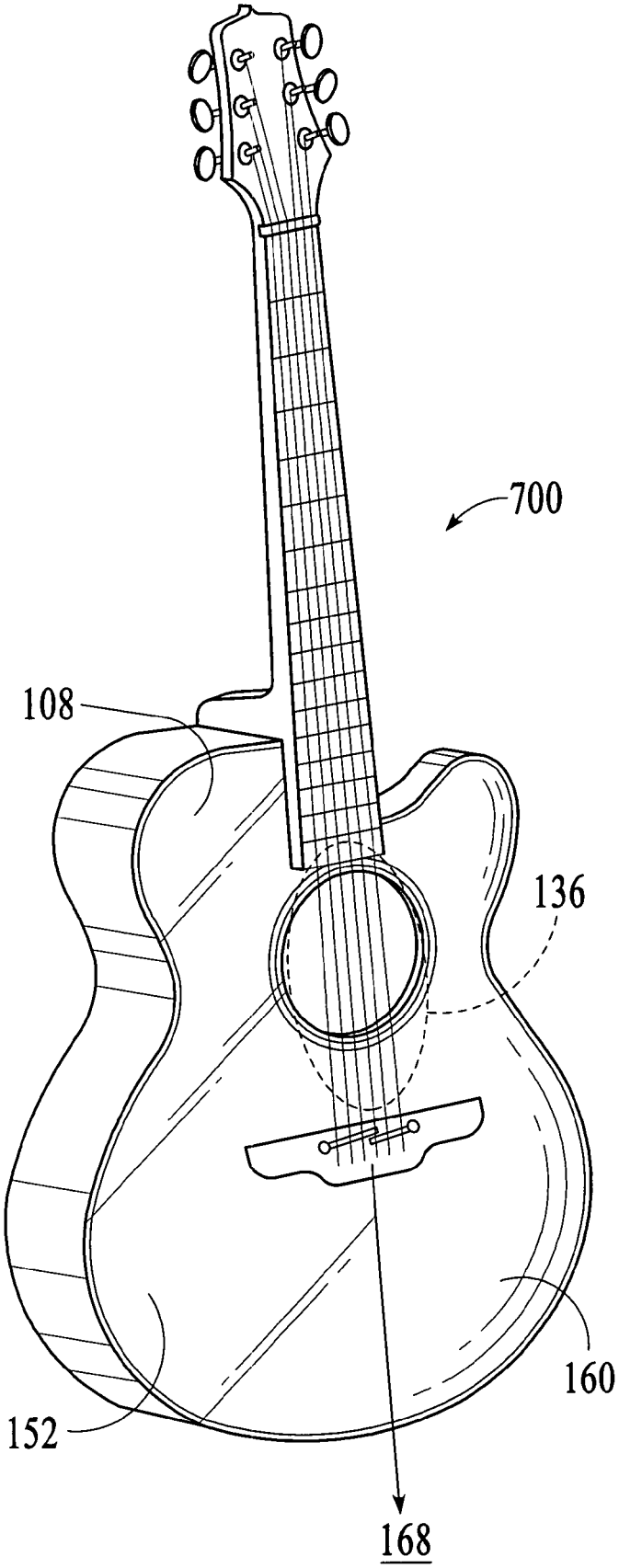
FIG. 7 shows a front view of an acoustic guitar 700 having a hybrid arch-top and flat-top soundboard, constructed according to one embodiment of the present invention.

FIG. 7 shows a front view of an acoustic guitar 700 having a hybrid arch-top and flat-top soundboard 108, implementing principles of the present invention. That is, on a bass or lower region 152 formed on one side of longitudinal axis 168, the soundboard 108 has a flat contour. On the other or treble side of longitudinal axis 168, the higher region 160 has an arched contour. A middle region 136 provides a gradual transition in contour between the lower and higher regions 152, 160.

Figure 8:
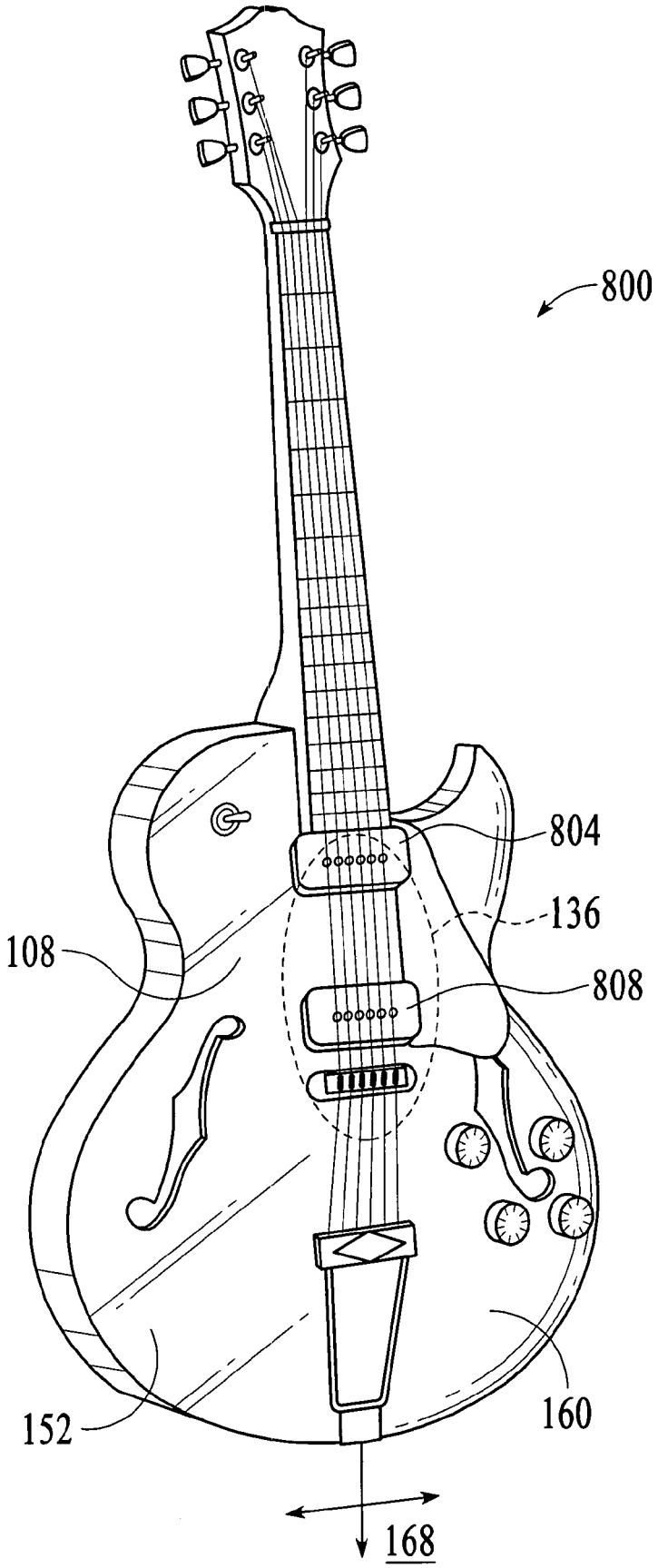
FIG. 8 shows a front view of a hollow body electric guitar 800 having a hybrid arch-top and flat-top soundboard, constructed according to one embodiment of the present invention.

FIG. 8 shows a front view of a hollow body electric guitar 800 having a hybrid arch-top and flat-top soundboard, implementing principles of the present invention. The electric hollow body guitar 800 includes P-90, i.e. "soapbar" pickups 804 and 808, tone and volume controls, and other suitable electrical and mechanical components found in electric guitars. For instance, other components coupled to electric guitars constructed according to embodiments of the present invention can include humbucker pickups, single coil pickups, piezo transducers, and active electronics and circuitry such as a battery-powered equalizer. The soundboard 108 of electric guitar 800 is formed to implement the principles of the present invention described above, namely a lower flat region 152 on the bass side of the soundboard 108, and a higher arched region 160 opposite the lower region 152 on a treble side of the soundboard 108 with respect to longitudinal axis 168. The hollow body electric guitar of FIG. 8 includes f-holes formed in the soundboard as shown.

Figure 9:
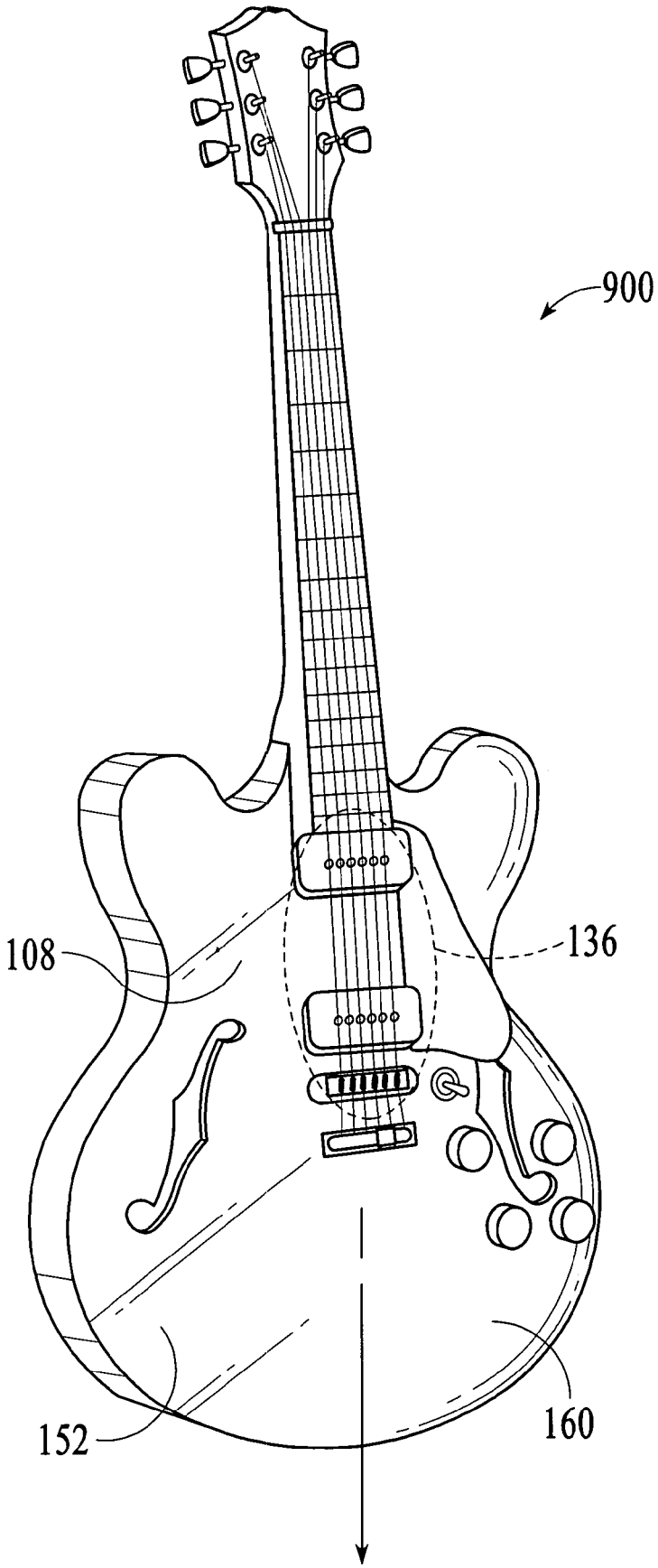
FIG. 9 shows a front view of a semi-hollow body electric guitar 900 having a hybrid arch-top and flat-top soundboard, constructed according to one embodiment of the present invention.

FIG. 9 shows a front view of a semi-hollow body electric guitar 900 having a hybrid arch-top and flat-top soundboard, constructed according to one embodiment of the present invention. The electric semi-hollow body guitar 900 includes humbucker pickups and other suitable electrical and mechanical components found in electric guitars. The soundboard 108 of electric guitar 900 is formed to implement the principles of the present invention described above, namely a lower flat region 152 on the bass side of the soundboard 108, and a higher arched region 160 on the treble side of the soundboard opposite the lower region 152 with respect to longitudinal axis 168. The hollow body electric guitar of FIG. 9 includes f-holes formed in the soundboard as shown. A middle region 136 provides a gradual transition in contour between the lower region 152 and higher region 160.

Figure 10:
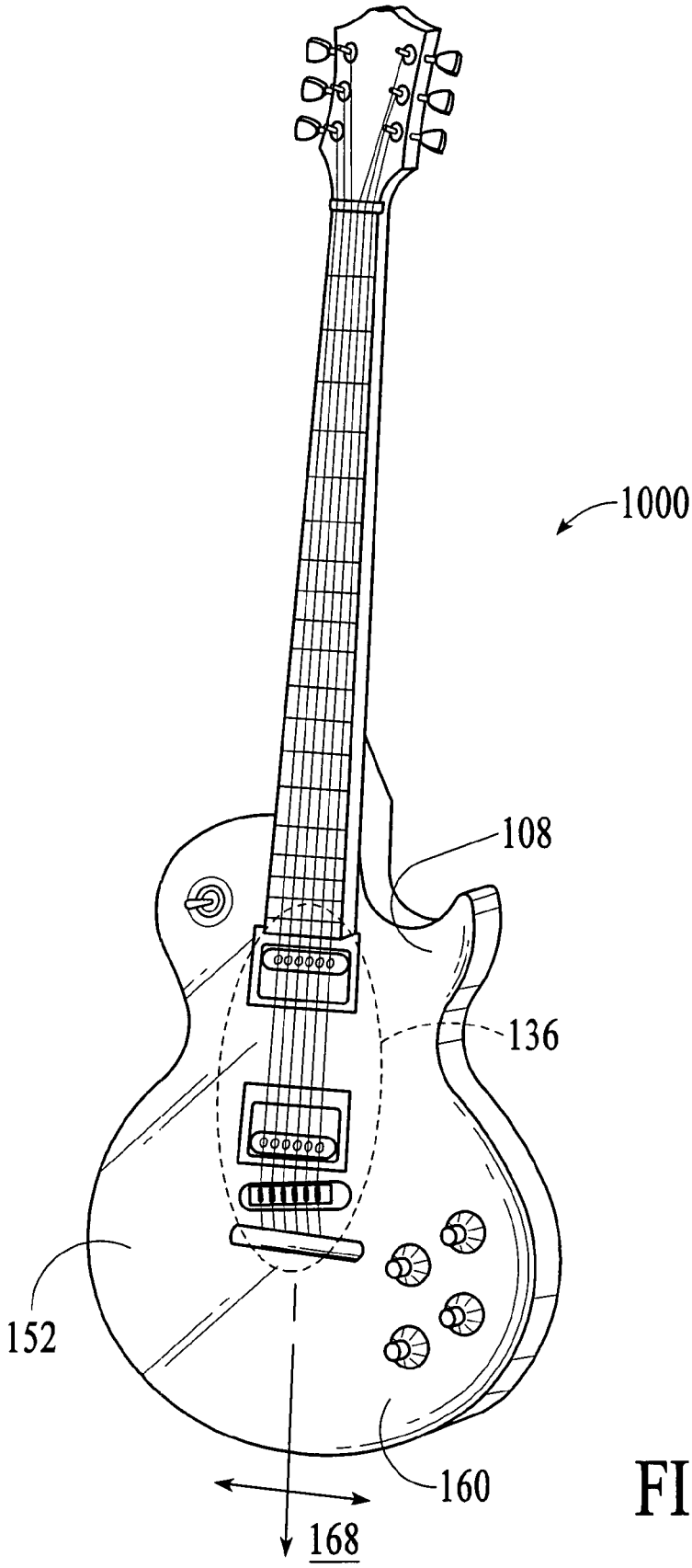
FIG. 10 shows a front view of a solid body electric guitar 1000 having a hybrid arch-top and flat-top soundboard, constructed according to one embodiment of the present invention.

FIG. 10 shows a front view of a solid body electric guitar 1000 having a hybrid arch-top and flat-top soundboard, constructed according to one embodiment of the present invention. The electric solid body guitar 1000 includes humbucker pickups and other suitable electrical and mechanical components found in electric guitars. The soundboard 108 of electric guitar 1000 is formed to implement the principles of the present invention described above, namely a lower flat region 152 (bass side) of the soundboard 108, and a higher arched region 160 (treble side) opposite the lower region 152 with respect to longitudinal axis 168. A middle region 136 provides a gradual transition in contour between the lower region 152 and higher region 160.

Figure 11:
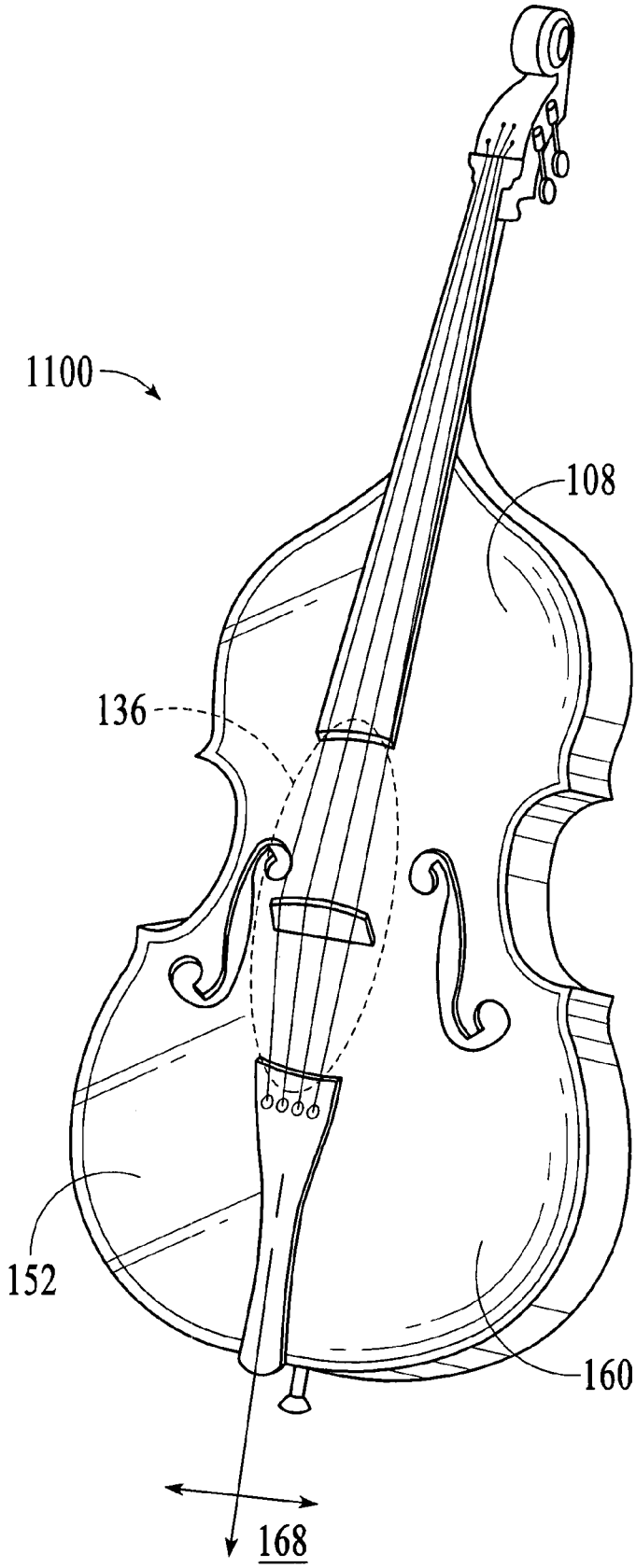
FIG. 11 shows a front view of an upright string bass 1100 having a hybrid arch-top and flat-top soundboard, constructed according to one embodiment of the present invention.

FIG. 11 shows an upright bass 1100 constructed according to another embodiment of the present invention, similarly including a soundboard 108 formed to have a flat lower region 152 (bass side) and arched higher region 160 (treble side) on opposite sides of a longitudinal axis 168. A middle region 136 provides a gradual transition in contour between the lower region 152 and higher region 160.

Figure 12:
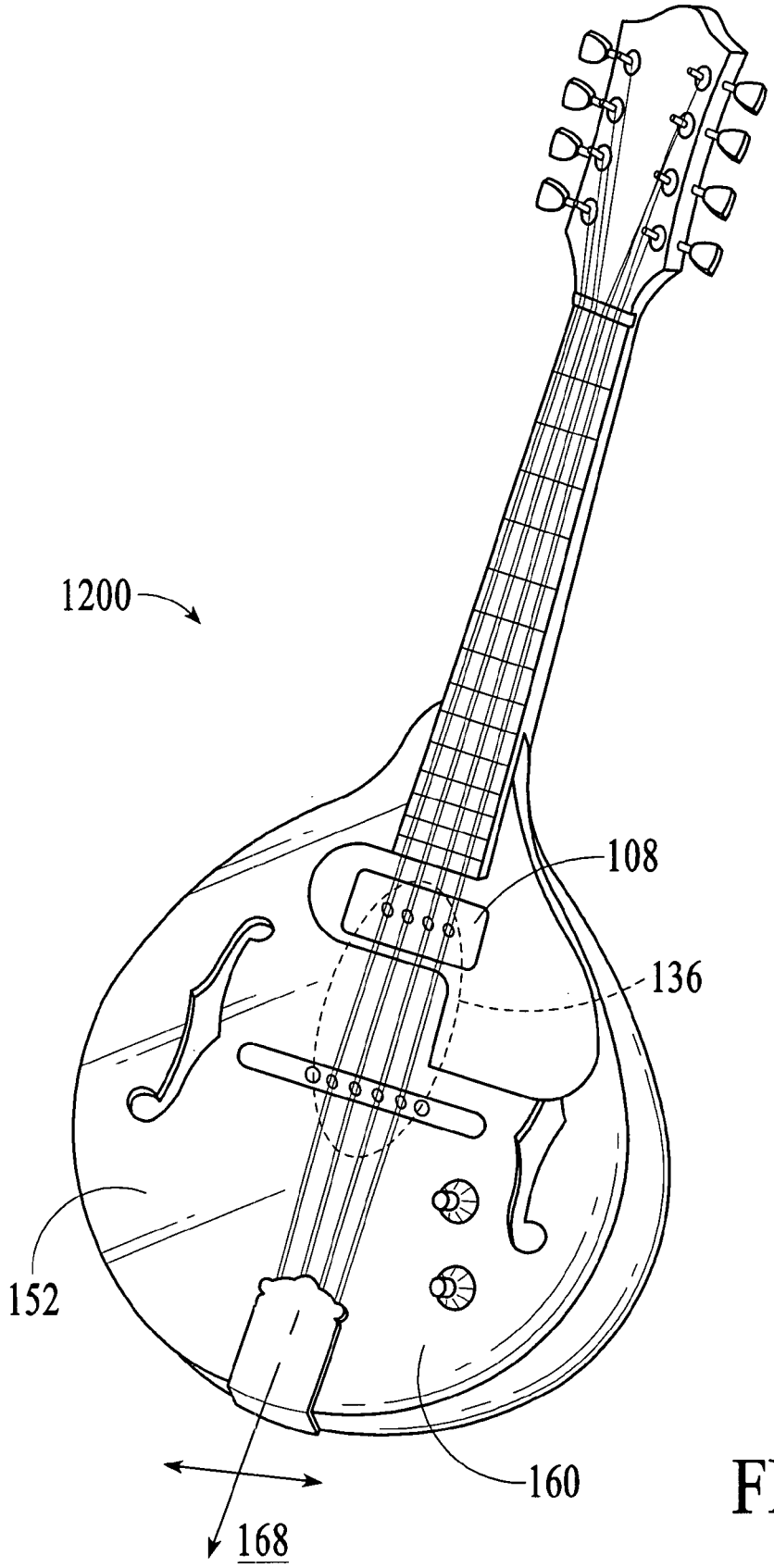
FIG. 12 shows a front view of a mandolin 1200 having a hybrid arch-top and flat-top soundboard, constructed according to one embodiment of the present invention.

FIG. 12 shows a mandolin 1200 implementing principles of the present invention, that is, having a soundboard 108 formed with a flat lower region 152 (bass side) and arched higher region 160 (treble side) generally on opposite sides of longitudinal axis 168. A middle region 136 provides a gradual transition in contour between the lower region 152 and higher region 160.

While the invention has been particularly shown and described with reference to specific embodiments thereof, it will be understood by those skilled in the art that changes in the form and details of the disclosed embodiments may be made without departing from the spirit or scope of the invention. It should also be understood that the embodiments described herein are presented for illustrative purposes and that not all of the described elements must be practiced to be within the scope of the invention.

In addition, although various advantages, aspects, and objects of the present invention have been discussed herein with reference to various embodiments, it will be understood that the scope of the invention should not be limited by reference to such advantages, aspects, and objects. Rather, the scope of the invention should be determined with reference to the following claims.

What is claimed is:

1. A stringed musical instrument comprising:

a body having a longitudinal axis situated along a length of the body, the body including a soundboard formed of a single piece of material, the soundboard having a bass side with respect to the longitudinal axis and a treble side opposite the bass side with respect to the longitudinal axis, the bass side of the soundboard, including a lower bout region, shaped to have a generally flat contour, the treble side of the soundboard shaped to have a generally arched contour, such that the soundboard has an asymmetrical contour;

a neck attached to the body, the neck having a hub adapted to couple one or more strings at a first end; and a bridge fitted to the soundboard, the bridge adapted to seat the one or more strings at a second end opposite the first end when extended over at least a portion of the neck and body.

2. The stringed musical instrument of claim 1, wherein the one or more strings include a bass string proximate the bass side of the soundboard.

3. The stringed musical instrument of claim 1, wherein the one or more strings include a treble string proximate the treble side of the soundboard.

4. The stringed musical instrument of claim 1, further comprising:

a tailpiece separate from the bridge and fitted to the body, the tailpiece adapted to receive and couple the one or more strings at the second end.

5. The stringed musical instrument of claim 1, wherein the longitudinal axis is in line with the neck.

6. The stringed musical instrument of claim 1, wherein the longitudinal axis is offset from the neck.

7. The stringed musical instrument of claim 1, the bridge assembly having a lower portion proximate the bass side of the soundboard and a higher portion proximate the treble side of the soundboard, the lower portion of the bridge being wider than the higher portion.

8. The stringed musical instrument of claim 7, wherein the one or more stiffening braces are located on the bass side of the soundboard.

9. The stringed musical instrument of claim 1, further comprising:

X braces attached to an interior side of the soundboard.

10. The stringed musical instrument of claim 1, further comprising:

one or more stiffening braces attached to an interior side of the soundboard.

11. The stringed musical instrument of claim 1, wherein a sound hole is formed in the soundboard.

12. The stringed musical instrument of claim 1, wherein one or more f-holes are formed in the soundboard.

13. The stringed musical instrument of claim 1, wherein the stringed musical instrument is one selected from the group consisting of an acoustic guitar, an electric guitar, an orchestral stringed instrument, a mandolin, a resonator, and a dulcimer.

14. A guitar comprising:

a body having a longitudinal axis situated along a length of the body, the body including a soundboard formed of a single piece of material, the soundboard having a bass side with respect to the longitudinal axis and a treble side opposite the bass side with respect to the longitudinal axis, the bass side of the soundboard, including a lower bout region, shaped to have a generally flat contour, the treble side of the soundboard shaped to have a generally arched contour, such that the soundboard has an asymmetrical contour;

a neck attached to the body, the neck having a fingerboard, the neck having a hub adapted to couple a plurality of strings at a first end; and a bridge assembly fitted to the soundboard, the bridge assembly having a lower portion proximate the bass side of the soundboard and a higher portion proximate the treble side of the soundboard, the bridge assembly adapted to seat the one or more strings at a second end opposite the first end when extended over at least a portion of the neck and body.

15. The guitar of claim 14, wherein the one or more strings include a bass string proximate the bass side of the soundboard.

16. The guitar of claim 14, wherein the one or more strings include a treble string proximate the treble side of the soundboard.

17. The guitar of claim 14, further comprising:

a tailpiece separate from the bridge assembly and fitted to the body, the tailpiece adapted to receive and couple the one or more strings at the second end.

18. The guitar of claim 14, wherein the longitudinal axis is in line with the neck.

19. The guitar of claim 14, wherein the longitudinal axis is offset from the neck.

20. The guitar of claim 14, the bridge assembly including:

a sustain plate attached to the soundboard;

a bridge coupled to the sustain plate, the bridge having a lower portion proximate the bass side of the soundboard and a higher portion proximate the treble side of the soundboard, the lower portion of the bridge being elevated above the soundboard a greater distance than the higher portion of the bridge.

21. The guitar of claim 14, wherein the lower portion of the bridge assembly is wider than the higher portion.

22. The guitar of claim 14, wherein the lower portion of the bridge assembly is thinner than the higher portion.

23. The guitar of claim 14, further comprising:

X braces attached to an interior side of the soundboard.

24. The guitar of claim 14, further comprising:

one or more stiffening braces attached to an interior side of the soundboard.

25. The guitar of claim 24, wherein the one or more stiffening braces are located on the bass side of the soundboard.

26. The guitar of claim 14, wherein the body is hollow.

27. The guitar of claim 14, wherein the body is semi-hollow.

28. The guitar of claim 14, wherein the body is solid.

29. The guitar of claim 14, wherein a sound hole is formed in the soundboard.

30. The guitar of claim 14, further comprising:

an adjustable port device fitted in a hole formed in the soundboard.

31. The guitar of claim 14, wherein one or more f-holes are formed in the soundboard.

32. The guitar of claim 14, further comprising:

one or more electrical components coupled to the body of the guitar.

33. The guitar of claim 32, wherein the electrical components include one or more piezo transducers.

34. The guitar of claim 32, wherein the electrical components include one or more pickups.

35. The guitar of claim 34, wherein the one or more pickups is selected from the group consisting of humbucker pickups, a single coil pickups, and P-90 pickups.

36. The guitar of claim 14, wherein the guitar is one selected from the group consisting of an acoustic guitar, an electric guitar, a right-handed guitar, a left-handed guitar, a 6-string guitar, a 12-string guitar, and a 7-string guitar.

37. A stringed musical instrument kit comprising:

a stringed musical instrument including:

a body having a longitudinal axis situated along a length of the body, the body including a soundboard formed of a single piece of material, the soundboard having a bass side with respect to the longitudinal axis and a treble side opposite the bass side with respect to the longitudinal axis, the bass side of the soundboard, including a lower bout region, shaped to have a generally flat contour, the treble side of the soundboard shaped to have a generally arched contour, such that the soundboard has an asymmetrical contour, a neck attached to the body, the neck having a fingerboard, the neck having a hub adapted to couple a plurality of strings at a first end, and a bridge assembly fitted to the soundboard, the bridge assembly having a lower portion proximate the bass side of the soundboard and a higher portion proximate the treble side of the soundboard, the bridge assembly adapted to seat the strings at a second end opposite the first end when extended over at least a portion of the neck and body; and a case adapted to receive the stringed musical instrument.

* * * * *